US005724634A

United States Patent [19]

Maruta

[11] Patent Number: 5,724,634

[45] Date of Patent: Mar. 3, 1998

[54] IMAGE FORMING DEVICE IN WHICH DEVELOPER ROLLER SPEED IS CONTROLLED IN DEVELOPER TRANSFER TO A PHOTOCONDUCTIVE DRUM

[75] Inventor: Takayuki Maruta, Tokyo, Japan

[73] Assignee: Ricoh Company, Ltd., Tokyo, Japan

[21] Appl. No.: 639,962

[22] Filed: Apr. 29, 1996

[30] Foreign Application Priority Data

Apr. 28, 1995 [JP] Japan ..... 7-129361

[51] Int. Cl.[6] ..... G03G 15/01

[52] U.S. Cl. ..... 399/227; 399/236

[58] Field of Search ..... 355/245, 326 R, 355/327; 118/645, 653; 399/227, 236, 53, 54

[56] References Cited

U.S. PATENT DOCUMENTS 3,987,756 10/1976 Katayama et al. .
4,615,612 10/1986 Ohno et al. .
4,743,938 5/1988 Ohno .
4,916,547 4/1990 Katsumata et al. .
5,168,319 12/1992 Kimura et al. ..... 355/326
5,325,151 6/1994 Kimura et al. ..... 355/200
5,471,292 11/1995 Okazawa ..... 355/326 R

*Primary Examiner*—Robert Beatty
*Attorney, Agent, or Firm*—Oblon, Spivak, McClelland, Maier & Neustadt, P.C.

[57] ABSTRACT

An image forming device including a photosensitive drum having a first motor disposed to rotate the photosensitive drum at a speed Vp; an optical unit disposed to create a charged pattern corresponding to an original image on the photosensitive drum; a revolver developing device disposed to apply developer to the photosensitive drum to create a visible image on the photosensitive drum, the revolver developing device including a second motor disposed to rotate the revolver developing device at a speed Vr, a plurality of developing devices each having a developing roller for carrying developer, and a third motor disposed to rotate the developing roller of each developing device at a speed Vs, wherein $Vr+Vs-Vp\neq 0$ such that the rotation speed of each developing roller is determined so that the developer on the developing roller moves relatively in a direction of a tangent line of the developing roller against the surface of the photosensitive drum when the developer on the developing roller comes separate from the developing roller and comes in contact with the photosensitive drum; and a transfer system disposed to transfer the visible image to a sheet.

12 Claims, 8 Drawing Sheets

FIG. 5A
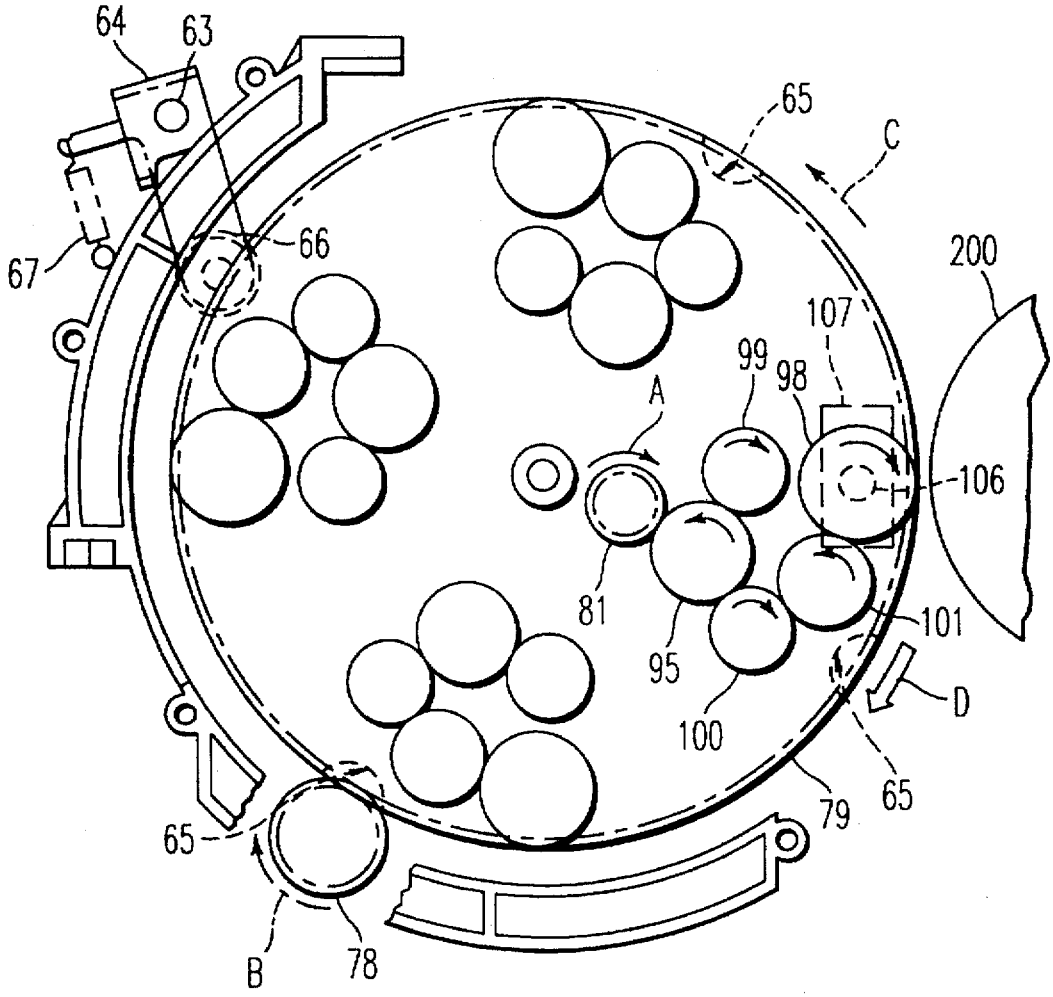
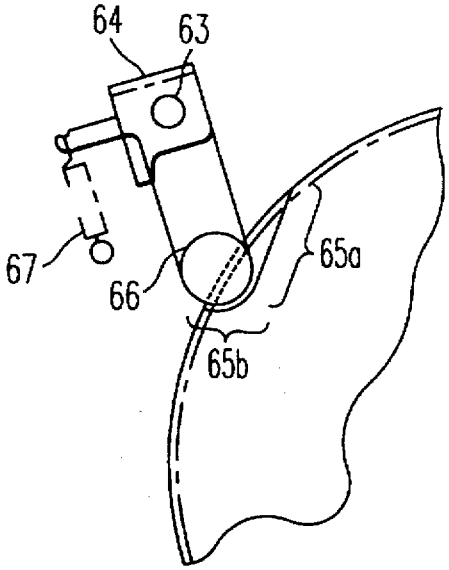
FIG. 5B
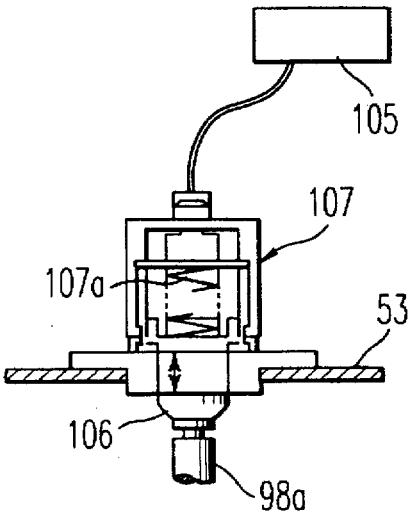
FIG. 5C

IMAGE FORMING DEVICE IN WHICH DEVELOPER ROLLER SPEED IS CONTROLLED IN DEVELOPER TRANSFER TO A PHOTOCONDUCTIVE DRUM

BACKGROUND OF THE INVENTION

1. Field of the Invention

The present invention relates to an image forming device, such as a copying machine, a facsimile apparatus, a printer or the like, and more particularly to an image forming device such as disclosed in U.S. patent application Ser. No. 08/553,776 filed Oct. 23, 1995, the disclosure of which is hereby incorporated by reference.

2. Description of the Related Art

In recent years, an image forming device, such as a color copying machine or a color printer, having a mobile (for example, rotating type) developing unit provided with a plurality of developing devices, has been proposed for reducing a size of an image carrying body, such as a photosensitive body, or a size of the device on the whole. In the image forming device, when developing a latent image on the image carrying body, a given developing device of the developing unit is moved to a developing position before the latent image on the image carrying body passes the developing position, so as to perform the development of the latent image. After completion of the development, the developing device is moved away from the developing position.

In the image forming device having the foregoing mobile developing unit, if, for example, developing devices each performing the development using a developer carrying body which carries on its surface a developer including toner, are provided, the developer on the developer carrying body contacts the image carrying body before the developing device reaches the developing position. As a result, the toner is likely to adhere to the image carrying body other than portions to be developed; that is, other than a region of the latent image. Further, when the developing device is moved away from the developing position after completion of the development, the developer on the developer carrying body similarly contacts the image carrying body so that the toner adheres to the image carrying body other than developed portions.

For preventing the toner adhesion to the undesired portions, Japanese Examined Patent Publication No. 6-42099, for example, has proposed an image forming device wherein application of a developing bias to a developing device continues to be performed from a time point where the developing device approaches a developing position, that is, the developing position is not yet reached, to a time point where the developing device moves a given distance away from the developing position. Further, Japanese Unexamined Patent Publication No. 4-328783, for example, has proposed a developing method, wherein, when developing a latent image on an image carrying body, a magnetic brush on a surface of a developer carrying body contacts the image carrying body after the start of operation of the developer carrying body and after application of a developing bias, while the magnetic brush is separated from the image carrying body before the stop of operation of the developer carrying body and before the stop of application of the developing bias.

Further, Japanese Unexamined Patent Publication No. 4-335667, for example, has proposed a development control method, wherein a developer carrying body is driven to rotate only when a developing device is located at a developing position, and wherein a developing bias is applied to the developer carrying body before the developing device reaches the developing position. After completion of the development, the developing bias applied to the developer carrying body is released after the developing device moves away from the developing position.

Still further, Japanese unexamined Publication No. 63-177164 discloses an image forming device in which a developer carrying body starts rotating before a developer on the body touches an image carrying body, and continues to rotate while the developer touches the image carrying body.

However, it has been determined through experiments by the present inventors that, when the developing bias including a d.c. component and an a.c. component is applied to the developer carrying body in the foregoing image forming devices, a problem may be caused depending on a pumping-up amount of the developer on the developer carrying body. For example, it has been found out that in case of using a two-component developer including toner and carrier, when a pumping-up amount of the developer on the developer carrying body is increased, even if the developing bias is applied before rendering the developer on the developer carrying body into contact with the image carrying body, and after completion of the development, the application of the developing bias is stopped after the developer on the developer carrying body is separated from the surface of the image carrying body, the carrier and the toner of the developer may adhere to the surface of the image carrying body. It has been further found that this unnecessary adhesion of the carrier and the toner is due to the fact that the carrier and the toner at a tip side of the developer carrying body where a binding power is weak, are activated due to an alternating electric field generated by the a.c. component of the developing bias so as to tend to move toward the image carrying body. The adhesion of the carrier and the toner of the developer to the surface of the image carrying body leads to lowering of the image quality and wasteful consumption of the developer.

SUMMARY OF THE INVENTION

Therefore, it is an object of the present invention to provide an improved image forming device which, even when a pumping-up amount of a developer on a developer carrying body is large, prevents unnecessary adhesion of the developer onto an image carrying body at the time of contact and separation between the developer on the developer carrying body and the image carrying body, so as to avoid lowering of the image quality and the wasteful consumption of the developer.

The above and other objects are achieved according to the present invention by providing a new and improved image forming device including a photosensitive drum having a first motor disposed to rotate the photosensitive drum; an optical unit disposed to create a charged pattern corresponding to an original image on the photosensitive drum; a revolver developing device disposed to apply developer to the photosensitive drum to create a visible image on the photosensitive drum, the revolver developing device including a second motor disposed to rotate the revolver developing device, a plurality of developing devices each having a developing roller for carrying developer, and a third motor disposed to rotate the developing roller of each developing device, wherein a rotation speed of each developing roller is determined so that the developer on the developing roller moves relatively in a direction of a tangent line of the developing roller against the surface of the photosensitive drum when the developer on the developing roller comes separate from the developing roller and comes in contact with the photosensitive drum; and a transfer system disposed to transfer the visible image to a sheet.

According to a first aspect of the present invention, when the developing roller and the revolver developing device rotate in a direction opposite a rotation direction of the photosensitive drum, a speed of the developing roller Vs, a speed of the revolver developing device Vr, and a speed of the photosensitive drum Vp are determined so that $Vs+Vr>Vp$.

According to a second aspect of the present invention, when the developing roller and the revolver developing device rotate in a direction opposite to a rotation direction of the photosensitive drum, a speed of the developing roller representative Vs, a speed of the revolver developing device Vr, and a speed of the photosensitive drum Vp are determined so that $Vs+Vr\cos(\theta r+\theta p)>Vp$, where $\theta r$=a revolving angle of the revolver developing device, and $\theta p$=a revolving angle of the photosensitive drum.

According to a third aspect of the present invention, when the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $Vs-Vr<Vp$.

According to a fourth aspect of the present invention, when the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $Vs-Vr\cos(\theta r+\theta p)<Vp$, where $\theta r$=a revolving angle of the revolver developing device, and $\theta p$=a revolving angle of the photosensitive drum.

According to a fifth aspect of the present invention, the device further includes a controller disposed to change the speed of the developing roller to be slower than a speed of the developing roller, when the developer on the developing roller comes in contact with the photosensitive drum and separates from the developing roller.

According to a sixth aspect of the present invention, when the developing roller and the revolver developing device rotate in a direction opposite to a rotation direction of the photosensitive drum, a speed of the developing roller Vs, a speed of the revolver developing device Vr, and a speed of the photosensitive drum Vp are determined so that $|(Vs+Vr)\div Vp|>1$.

According to a seventh aspect of the present invention, when the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $|(Vs-Vr)\div Vp|>1$.

BRIEF DESCRIPTION OF DRAWINGS

The present invention will be understood more fully from the detailed description given hereinbelow, taken in conjunction with the accompanying drawings, wherein:

FIG. 2(*b*) is also a schematic illustration showing movement of rotation of the photosensitive drum 200, the revolver developing unit 230, and the developing roller of FIG. 1, when the developer on the developing roller separates from the photosensitive drum.

FIG. 5A is a perspective view, seen from a front side, showing a drive system of the revolver developing unit shown in FIG. 3;

FIG. 5B is a diagram for explaining a positioning mechanism of the revolver developing unit shown in FIG. 3;

FIG. 5C is a diagram for explaining the application of the developing bias voltage to a developing device of the revolver developing unit shown in FIG. 3;

DESCRIPTION OF THE PREFERRED EMBODIMENT

Figure 1:
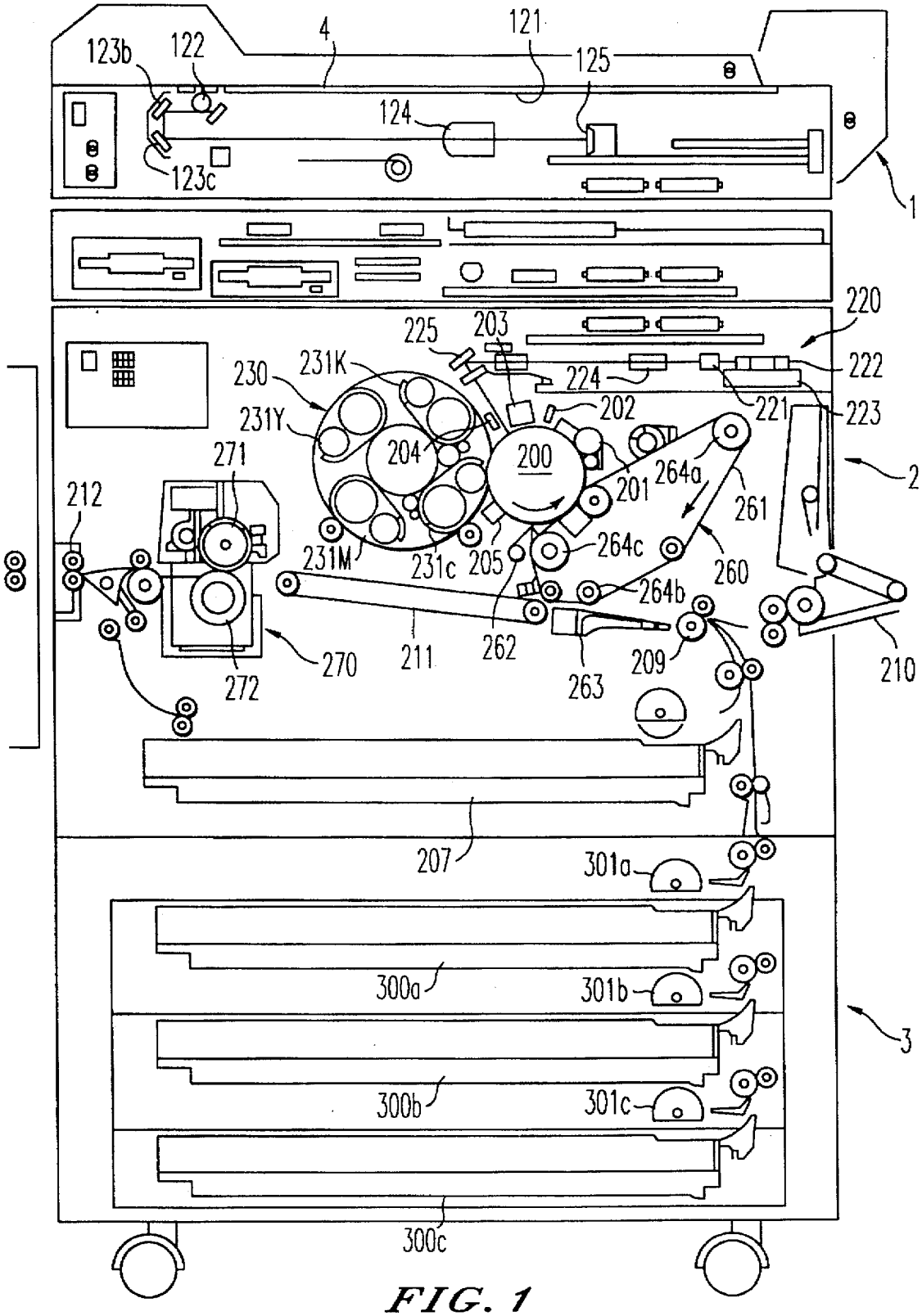
FIG. 1 illustrates the schematic structure of the color copying machine according to the present invention.

Now, a preferred embodiment of the present invention will be described hereinbelow with reliance to the accompanying drawings, wherein like reference numbers represent identical of corresponding parts throughout the several views in which the present invention is applied to an electrophotographic color copying machine (hereinafter referred to as "color copying machine") which is an image forming device.

First, a schematic structure and an operation of the color copying machine according to the preferred embodiment will be described with reference to FIGS. 1 to 6B. The color copying machine includes a color image reading device (hereinafter referred to as "color scanner") 1, a color image recording device (hereinafter referred to as a "color printer") 2, and a paper feeding bank 3.

The color scanner 1 forms an image of the original document 4 placed on a contact glass 121 onto a color sensor 125 via a group of mirrors 123*a*–123*c* and a lens 124 using an illuminating lamp 122, so as to read color image information of the original 4 for each of separated colors such as red, green and blue (hereinafter referred to as "R", "G" and "B", respectively) for conversion to a corresponding electric image signal. In this embodiment, the color sensor 125 includes color separating means for separation into R, G and B and a photoelectric conversion element, such as a CCD for simultaneously reading three color images obtained by, separating in color the image of the original 4. Then, based on signal strength levels of the separated R, G, and B color images obtained by the color sensor 125, an image processing section (not shown) performs a color conversion process to derive color image data of black (hereinafter referred to as "Bk"), cyan (hereinafter referred to as "C"), magenta (hereinafter referred to as "M") and yellow (hereinafter referred to as "y").

An operation of the color scanner 1 for obtaining the color image data of Bk, C, M and Y is as follows.

In response to a scanner start signal matching a timing of an operation of the color printer 2, an optical system, including the lighting lamp 122, the group of mirrors 123*a*–123*c* and the like, scans the original 4 in a direction of an arrow in FIG. 1 to obtain color image data of one color per scan. By repeating the scanning operation four times in total, four sets of color image data are obtained in sequence.

In response to this, the color printer 2 generates images based on the four color image data in sequence to superpose them one by one so that the final four-full-color image is achieved.

The color printer 2 includes a photosensitive drum 200 as an image bearing or carrying body, an optical writing unit 220, a revolver developing unit 230, an intermediate transfer device 260, and a fixing device 270.

The photosensitive drum 200 rotates in the counterclockwise direction as shown by an arrow in FIG. 1. Around the photosensitive drum 200 are arranged a drum cleaning device 201, a charge-removing lamp 202, a charging device 203, a potential sensor 204, a selected developing device of the revolver developing unit 230, a development concentration pattern detector 205, and an intermediate transfer belt 261 of the intermediate transfer device 260.

The optical writing unit 220 converts the color image data from the color scanner 1 into light signals for writing onto the photosensitive drum 200 so as to form thereon an electrostatic latent image corresponding to the image of the original 4. The optical writing unit 220 includes a semiconductor laser 221 as a light source, a control section (not shown) for controlling an operation of the semiconductor laser 221, a polygon mirror 222 rotated by a motor 223, an f/θ lens 224, and a reflecting mirror 225.

The revolver developing unit 230 includes a Bk developing device 231K, a C developing device 231C, an M developing device 231M, a Y developing device 231Y, and a later-described revolver drive section for rotating each of the developing devices in the counterclockwise direction as shown by an arrow. Each developing device 231 includes a developing sleeve which rotates while keeping an ear or space of developer (a portion of the developer) in contact with the surface of the photosensitive drum 200 for developing the electrostatic latent image formed thereon. Each developing device further includes a developer agitation paddle which rotates for pumping up and agitating the developer. Toner in each developing device 231 is charged in the negative polarity due to agitation with a ferrite carrier. Further, a developing bias, in the form of a negative d.c. voltage Vdc superimposed with an a.c. voltage Vac, is applied to each developing sleeve from a developing bias source (not shown) so that the developing sleeve is biased at given potentials relative to a metal base layer of the photosensitive drum 200. In a standby state of the color copying machine, the revolver developing unit 230 is set with the Bk developing device 231K at a developing position. When a copying operation is started, reading of Bk color image data is started at a given timing in the color scanner 1. Then, writing by a laser beam is started based on the Bk color image data so as to start formation of a corresponding electrostatic latent image on the photosensitive drum 200. Hereinafter, an electrostatic latent image achieved by Bk color image data is referred to as the "Bk latent image", which also applies to C, M and Y in the same manner. For developing the Bk latent image from its tip or edge, the Bk developing sleeve starts to be rotated before the tip or front edge of the Bk latent image reaches the developing position. Then, the Bk latent image starts to be developed with the Bk toner. The development of the Bk latent image continues until a rear edge of the Bk latent image reaches the developing position. When the rear edge of the Bk latent images passes the developing position, the revolver developing unit 230 is immediately rotated until the developing device for a next color comes to the developing position. This should be completed at least before a tip (front edge) of an electrostatic latent image achieved by the next color image data reaches the developing position.

The revolver developing unit 230 will be described later in further detail.

The intermediate transfer device 260 includes the intermediate transfer belt 261, a belt cleaning device 262, and a paper transfer corona discharge device (hereinafter referred to as a "paper transfer device") 263. The intermediate transfer belt 261 is extended around and supported by a drive roller 264*a*, a transfer opposed roller 264*b*, a cleaning opposed roller 264*c* and a group of compliance rollers. An operation of the intermediate transfer belt 261 is controlled by a drive motor (not shown) via the rollers. A material of the intermediate transfer belt 261 is ETFE (ethylene tetrafluoroethylene) which has a surface electrical resistance of $10^8$–$10^{10}\Omega/\square$. The belt cleaning device 262 includes an inlet seal, a rubber blade, a discharge coil, a shift mechanism of the inlet seal and the rubber blade. The inlet seal and the rubber blade are spaced from the intermediate transfer belt 261 by the shift mechanism while the images of the second, third and fourth colors are transferred to the belt 261 after the first Bk image has been transferred to the belt 261. The paper transfer device 263 transfers in a lump (all at once) the superposed toner image on the intermediate transfer belt 261 onto transfer paper 5 by applying a d.c. voltage which may, if desired, include an a.c. voltage through corona discharge.

In a transfer paper cassette 207 within the color printer 2 and in transfer paper cassettes 300*a*, 300*b* and 300*c* within the paper feeding bank 3, transfer paper 5 of various sizes are stored. From the cassette storing the transfer paper 5 of a selected size, the transfer paper 5 is carried and fed toward a pair of resist rollers 209 via paper feeding rollers 208, 301*a*, 301*b* or 301*c*. Further, a manual feeding tray 210 is provided at the right side of the color printer 2 for manually feeding OHP (overhead projector) paper, thick paper or the like.

In the color copying machine having the foregoing structure, when an image forming cycle is started, the photosensitive drum 200 is rotated in the counterclockwise direction and the intermediate transfer belt is rotated in the clockwise direction, driven by the drive motor (not shown). Then, the Bk toner image, the C toner image, the M toner image and the Y toner image are formed in sequence on the photosensitive drum 200 and transferred in sequence onto the intermediate transfer belt 261 named in a superposed manner so as to form the toner image on the belt 261.

The formation of the Bk toner image is achieved in the following manner.

The charging device 203 charges, through corona discharge, the photosensitive drum 200 uniformly at about −700V with negative electricity. Then, the semiconductor laser 221 performs a raster exposure based on the Bk image signal from the color scanner 1. When the raster exposure is performed, an exposed portion of the photosensitive drum 200, initially charged uniformly, loses the charges proportional to an exposed light quantity so that the Bk electrostatic latent image is formed on the photosensitive drum 200. When the negatively charged Bk toner on the Bk developing sleeve touches the photosensitive drum 200, the Bk toner does not adhere to a portion of the photosensitive drum 200 where the negative charges remain, while the Bk toner does adhere to the exposed portion where no charges remain so that the Bk toner image corresponding to the Bk latent image is formed. The Bk toner image formed on the photosensitive drum 200 is transferred onto the intermediate transfer belt 261, which is rotated at a constant speed and in contact with the photosensitive drum 200, by means of the paper transfer device 263. Hereinafter, the transfer of the toner image from the photosensitive drum 200 onto the intermediate transfer belt 261 will be referred to as a "belt transfer".

Some non-transferred toner remaining on the photosensitive drum 200 is removed by the drum cleaning device 201 so that the photosensitive drum 200 can be subsequently used. The recovered toner is carried via a recovery pipe and stored in a discharge toner tank (not shown).

Subsequent to the formation of the Bk image, the process of the C image formation is advanced. Specifically, reading of the C image data is started at a given timing by the color scanner 1, and formation of the C electrostatic latent image is formed by the laser beam writing based on the C image data. Then, the rotation of the revolver developing unit 230 is performed after the rear edge of the Bk image passes the developing position and before the tip of the C latent image reaches the developing position. Subsequently, the C developing device 231C is set at the developing position to develop the C latent image with the C toner. Thereafter, when the rear edge of the C image passes the developing position, the revolver developing unit 230 is rotated to move the M developing device 231M to the developing position. The M developing device is set at the developing position before the tip of the M latent image reaches the developing position.

The foregoing processes are repeated until the belt transfer of the Y toner image is accomplished.

On the intermediate transfer belt 261, the Bk, C, M and Y toner images are transferred in sequence with their positions matched on the same plane so as to form the four-color superposed toner image. In the next transfer process, the four-colored toner image is transferred, each color at the same time, onto the transfer paper 5 by the paper transfer device 263.

At the time of starting the foregoing image forming operation, the transfer paper 5 is fed from the transfer paper cassette or the manual feeding tray 210 and stands by at a nipping portion between the pair of resist rollers 209. The resist rollers 209 are driven so as to match the tip of the transfer paper 5 with the tip of the toner image on the intermediate transfer belt 261 to achieve resist matching between the transfer paper 5 and the toner image when the tip of the toner image on the belt 261 reaches the paper transfer device 263. Then, the transfer paper 5, as being superposed with the toner image on the intermediate transfer belt 261, passes on the paper transfer device 263 which is at a positive potential. At this time, the transfer paper 5 is charged with positive electricity by corona discharge so that most of the toner images are transferred onto the transfer paper 5. Subsequently, the transfer paper 5 is discharged when passing a position confronting a separation charge-removal device (not shown) which is arranged at a left side of the paper transfer device 263 for generating a.c. and d.c. corona discharge. Thus, the transfer paper 5 is separated from the intermediate transfer belt 261 and moves to a conveyer belt 211.

Thereafter, the transfer paper 5 with the transferred four-color superposed toner image is carried by the conveyer belt 211 to the fixing device 270 where the toner image is melted and fixed at a nipping portion between a long roller 271 controlled at a given temperature and a pressure roller 272. Then, the transfer paper 5 is conveyed out of the machine body through a pair of discharge rollers 212 and stacked on a copy tray (not shown) with the right side thereof facing upward, thus achieving a full color copy.

After the belt transfer, the surface of the photosensitive drum 200 is cleaned by the drum cleaning device 201 (brush roller, rubber blade) and uniformly discharged by the charge-removing lamp 202. Further, after the toner image is transferred onto the paper 5, the surface of the intermediate transfer belt 261 is cleaned by again pressing the rubber blade of the belt cleaning device 262 onto the surface of the belt 261 using the shift mechanism.

In case of repeating copying, the operation of the color scanner 1 and the image formation onto the photosensitive drum 200 advance again to an image forming process of a first color (Bk) for the second copy at a given timing subsequent to the image forming process of the fourth color (Y) for the first copy. On the other hand, subsequent to the transfer process of the four-color superposed toner image onto the transfer paper 5 for the first copy, the belt transfer of the Bk toner image for the second copy is performed onto a region of the belt which has been cleaned by the belt cleaning device 262 on the surface of the intermediate transfer belt 261. Subsequently, the foregoing processes for the first copy are performed in the same manner.

The foregoing description relates to a copy mode for obtaining the four full-color copy. On the other hand, in case of a three-color copy mode or a two-color copy mode, the foregoing operations are performed for designated colors and for a required number of copies. In case of a monochromic copy mode, until a required number of copies are achieved, only one developing device for a designated color of the revolver developing unit 230 operates so as to obtain copies in the designated color in a continuous manner while the rubber blade of the belt cleaning device 262 is held pressed onto the intermediate transfer belt 261. In case of an A3-size full-color copy mode, it is preferable that a toner image of one color is formed every time the intermediate transfer belt 261 makes one round so that toner images of four colors are formed when the belt 261 makes four rounds. However, for reducing a size of the machine, that is reducing a circumferential length of the intermediate transfer belt 261, and for ensuring a high copy speed for a small-sized copy and maintaining a copy speed for a maximum-sized copy, it is preferable that a toner image of one color is formed every time the intermediate transfer belt 261 makes two rounds. In this case, during a first round of the belt 261 after the belt transfer of the Bk toner image onto the belt 261, the development and the transfer in the color printer 2 are not performed so that the belt 261 rotates for at least part of a revolution without the transfer of an image. Then, during a second revolution of the belt 261, the development with the C (next color) toner is performed and the C toner image is transferred onto the belt 261. The rotation of the revolver developing unit 230 for switching the developing device is achieved during the foregoing idle running of the belt 261.

Now, the revolver developing unit 230 will be described hereinbelow in detail.

Figure 3:
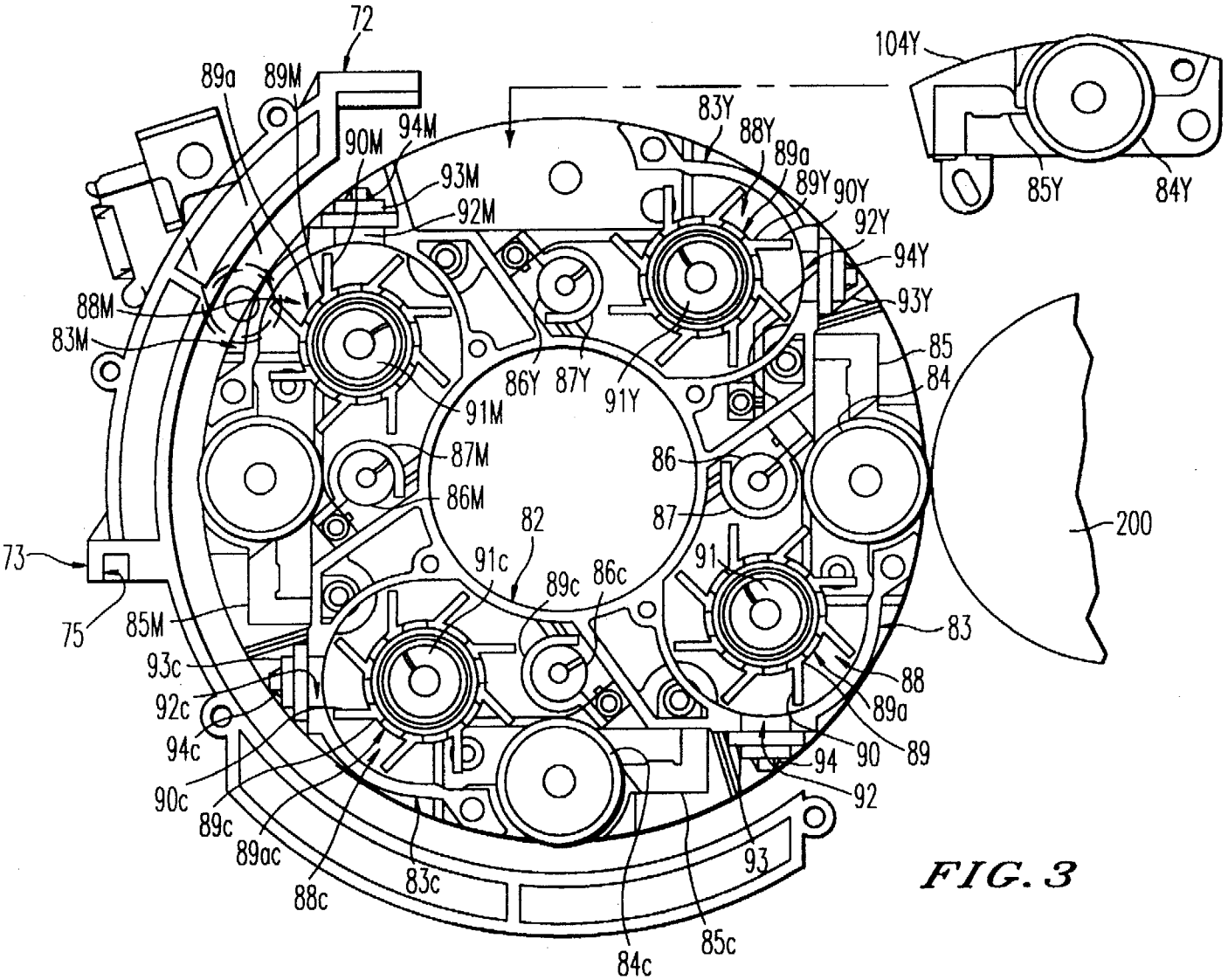
FIG. 3 is a sectional view showing a revolver developing unit employed in the color copying machine shown in FIG. 2.

FIG. 3 is a sectional view showing an internal structure of the revolver developing unit 230 wherein the developing devices 231K, 231C, 231M and 231Y are provided as a unit. The revolver developing unit 230 includes a partition provided between its front and rear disk-like end walls 50 and 51 (see FIG. 4). The partition includes a hollow cylindrical portion 82 into which a cylindrical Bk toner bottle containing the Bk toner is insertable, and developing device casings 83, 83C, 83M and 83Y which extend radially from the hollow cylindrical portion 82 to define four developing chambers of essentially the same shape in a circumferential direction around the hollow cylindrical portion 82. Each of the developing chambers contains therein a two-component developer including carrier and toner of a corresponding color. In the example shown in the figure, the developing chamber of the Bk developing device 231K containing the Bk toner and the carrier is located at the developing position confronting the photosensitive drum 200. From the developing chamber of the Bk developing device 231K, the developing chamber of the Y developing device 231Y containing the Y toner and the carrier, the developing chamber of the M developing device 231M containing the M toner and the carrier, and the developing chamber of the C developing device 231C containing the C toner and the carrier are arranged in the counterclockwise direction in the order named.

Since the four developing chambers have the same internal structure, the internal structure of only the Bk developing chamber located at the developing position in FIG. 3 will be described hereinbelow, while explanation of the internal structures of the Y, M and C developing chambers will be omitted by assigning the same reference numerals to the corresponding elements as those of the Bk developing chamber along with suffix letters Y, M and C for identifying the elements of the Y, M and C developing chambers, respectively.

In the Bk developing device 231K located at the developing position in FIG. 3, the developing device casing 83 is formed with an opening directed to the photosensitive drum 200. In the Bk developing chamber, a developing roller 84 as a developer bearing or carrying body formed by the developing sleeve having a magnet therein is provided as being party exposed via the opening of the casing 83. Further, in the Bk developing chamber are provided a doctor blade 85 held by the developing roller 84 for regulating an amount of the developer carried to a position confronting the photosensitive drum 200, an upper conveying screw 86 for conveying a portion of the developer regulated by the doctor blade 85 to remain in the developing chamber, along the center axis from rear to front, a guide 87 of the upper conveying screw 86, and an agitation paddle 88 for agitating the developer in the developing chamber. The agitation paddle 88 includes a hollow cylindrical portion 89 formed with a plurality of developer discharge holes 89*a*, each extending over a width of the developing roller 84, and a plurality of agitation plates 90 extending radially from the circumference of the hollow cylindrical portion 89. In the hollow cylindrical portion 89, a lower conveying screw 91 is arranged for conveying the developer along the center axis in a direction opposite to the direction in which the upper conveying screw 86 conveys the developer. The developing device casing 83 is further formed at its portion below the lower conveying screw 91 with a developer discharge port 92 extending in a direction of the rotation axis. The developer discharge port 92 is used when changing the developer in the developing chamber due to deterioration of the exposure as an outlet for the deteriorated developer or, if occasion demands, as an inlet for non-used developer (toner mixed). The developer discharge port 92 is normally closed by a cap 93 fixed to the casing 83 by a screw 94.

In order to effectively discharge the deteriorated developer via the developer discharge port 92, it is preferable to draw out the revolver developing unit 230 from the machine body via a carrying pedestal (not shown), and rotate a later-described developing input gear 95 (see FIG. 5A) and others using a jig or the like so as to discharge the deteriorated developer by rotating the developing roller 84, the upper and lower conveying screws 86, 91 and the agitation paddle 88. When introducing the non-used developer via the developer discharge port 92, the introduced non-used developer can be dispersed uniformly into the remaining developer by rotating the developing roller 84, the upper and lower conveying screws 86, 91 and the agitation paddle 88 as described above.

Figure 4:
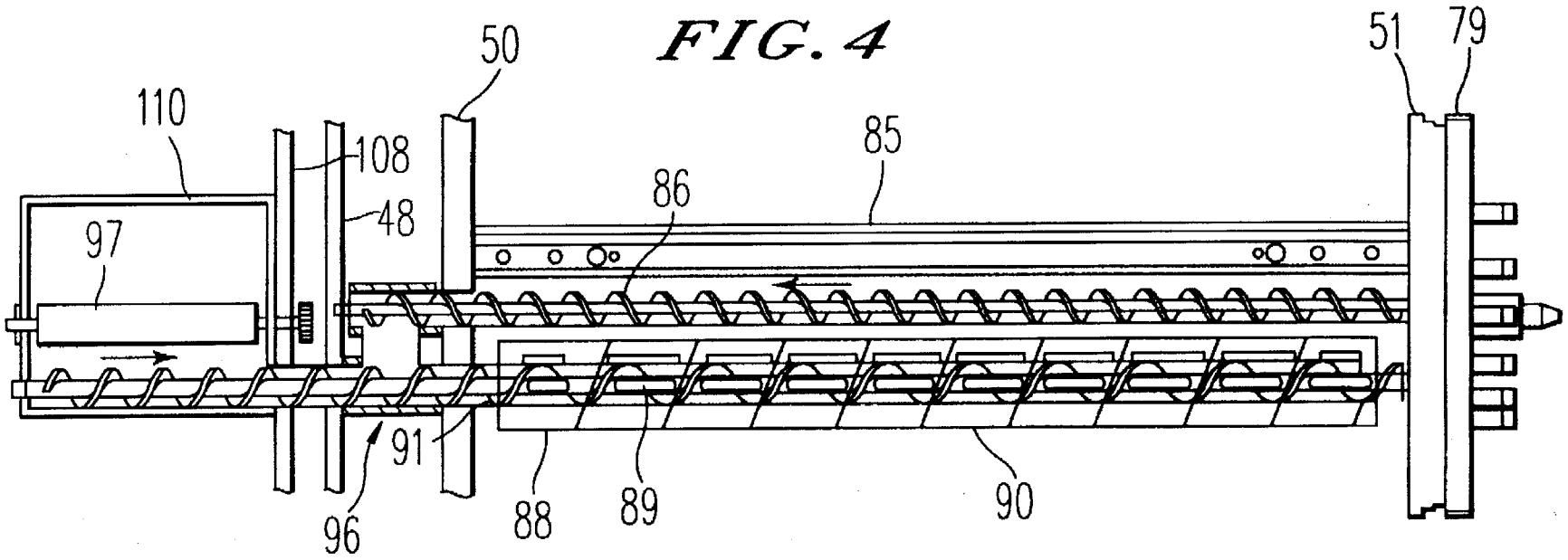
FIG. 4 is a diagram for explaining a structure for toner transportation between a developing device and a toner storing unit of the revolver developing unit shown in FIG. 3.

FIG. 4 is a longitudinal section, taken along a plane including a center shaft 52 of the upper and lower conveying screws 86 and 91 of the Bk developing device 231K. As shown in the figure, the front ends of the upper and lower conveying screws 86 and 91 extend beyond or to the outside of an effective width of the developing roller 84 (in the figure, beyond the front end wall 50 of the revolver developing unit 230). At this extended portion, a falling portion 96 is provided for allowing the developer carried by the upper conveying screw 86 to fall onto the lower conveying screw 91 by its own weight. The front end of the lower conveying screw 91 extends further to the front side beyond the falling portion 96 and into a communication chamber arranged below a toner feeding roller 97 of a toner storing unit (not shown) provided corresponding to each of the developing chambers. With this arrangement, the developer pumped up by the developing roller 84 and regulated by the doctor blade 85 and then conveyed to the front side by the guide 87 and the upper conveying screw 86 falls onto the lower conveying screw 91 at the falling portion 96 and then is conveyed to within the effective width of the developing roller 84 so as to be discharged into the developing chamber via the developer discharge holes 89*a*, within the foregoing effective width, of the hollow cylindrical portion 89 of the agitation paddle 88, thus again being allowed to be carried by the developing roller 84. In other words, the so-called lateral agitation of the developer is achieved in the developing chamber. Further, the developer discharged via the developer discharge holes 89*a* to a developer sump at a lower portion of the developing chamber is agitated by rotation of the agitation plates 90 of the agitation paddle 88 so that the so-called longitudinal agitation of the developer is achieved. Further, the toner fallen onto the lower conveying screw 91 within the foregoing communication chamber due to rotation of the toner feeding roller 97 is conveyed by the lower conveying screw 91 to the falling portion 96 where the toner is mixed into the developer fallen from the upper conveying screw 86. This mixed developer is introduced into the developing chamber via the developer discharge holes 89*a* so as to increase a toner concentration of the developer in the developing chamber.

FIG. 5A is a perspective view, seen from the front side, of the rear wall 51 of the revolver developing unit 230. As shown in the figure, various gears are provided at a rear side of a revolver input gear 79 which is fixed to a rear side of the rear wall 51. Specifically, a developing roller gear 98 is fixed to an end of a shaft of the developing roller 84 projecting to the rear side of the revolver input gear 79 through the rear wall 51. Similarly, upper and lower conveying screw gears 99 and 100 are fixed to ends of shafts of the upper and lower conveying screws 86 and 91, respectively, each projecting to the rear side of the revolver input gear 79 through the rear wall 51. In the example shown in the figure, an idler gear 101 engaged with the developing roller gear 98 and with the lower conveying screw gear 100, and the developing input gear 95 for engagement with a developing output gear 81 mounted to a rear plate 53 of the machine body and driven by a developing drive motor 80 are mounted at the rear side of the rear wall 51 of the revolver developing unit 230. When the revolver developing unit 230 with these gears at the rear side of the rear wall 51 is inserted into the machine body as being received on the carrying pedestal, the developing output gear 81 on the side of the machine body and the developing input gear 95 on the side of the revolver developing unit 230 engage with each other as shown in FIG. 5A. Simultaneously, as shown in FIG. 5A, the revolver input gear 79 on the side of the revolver developing unit 230 engages with a revolver output gear 78 on the side of the machine body.

Figure 6A:
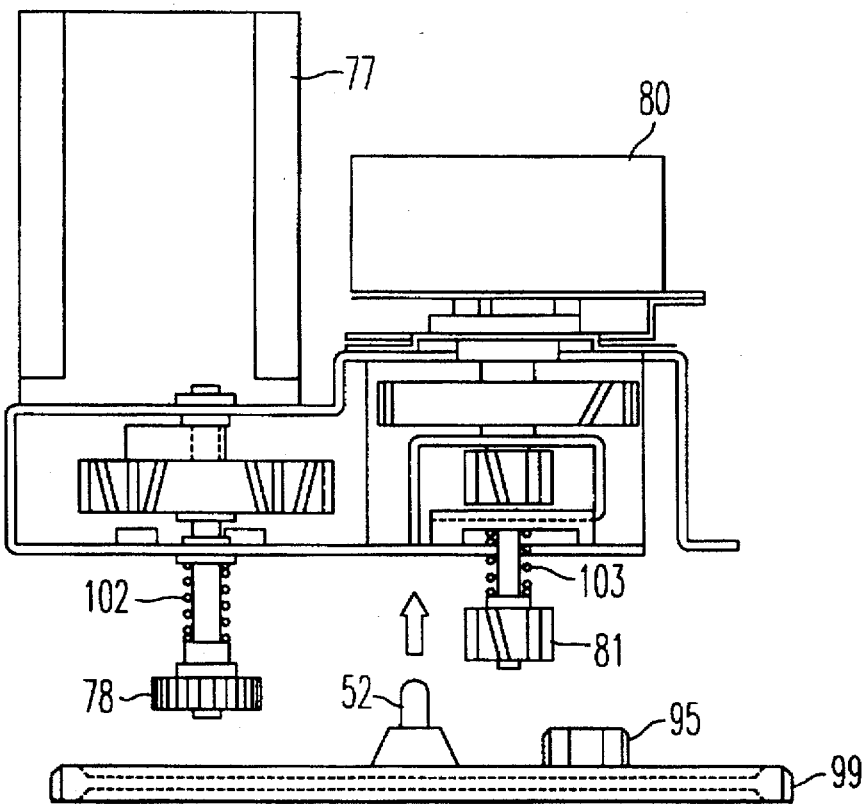
FIG. 6A is a plan view showing a drive motor section for the revolver developing unit shown in FIG. 3.
Figure 6B:
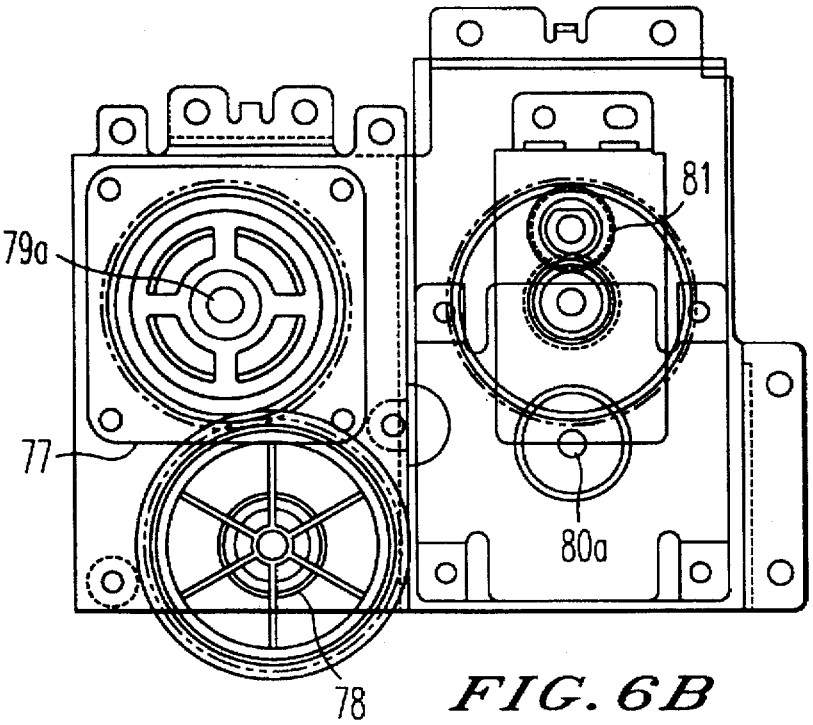
FIG. 6B is a front view showing the drive motor section shown in FIG. 6A.

FIG. 6A is a plan view showing a drive motor section of the revolver developing unit 230, and FIG. 6B is a front view showing the drive motor section. As seen from these figures, for facilitating the engagement between the gears on the sides of the machine body and the revolver developing unit 230 upon insertion of the foregoing carrying pedestal, the gears 78 and 81 on the side of the machine body are mounted so as to be displaceable in a slide direction (thrust direction) of the carrying pedestal and urged toward the front side of the machine body by means of springs 102 and 103, respectively. With this arrangement, even if the gears 78 and 81 on the side of the machine body and the gears 79 and 95 on the side of the revolver developing unit 230 are in a positional relationship to interfere with each other upon insertion of the carrying pedestal, the gears 78 and 81 on the side of the machine body move backward to achieve the complete insertion of the carrying pedestal. The interference between the gears are eliminated due to actuation of the gears 78 and 81 on the side of the machine body thereafter, and the gears 78 and 81 are pushed out toward the revolver developing unit 230 to their utmost points due to the biasing force of the springs 102 and 103, respectively, so as to achieve the complete engagement with the gears 79 and 95 on the side of the revolver developing unit 230.

In FIG. 5A showing the state where the complete gear engagement is achieved, the developing output gear 81 is driven in a direction of an arrow A to rotate the upper and lower conveying screw gears 99 and 100 via the developing input gear 95 so that the upper and lower conveying screws 86 and 91 are rotated. Further, via the developing input gear 95, the lower conveying screw gear 100, and the idler gear 101, the developing roller gear 98 is rotated to drive the developing roller 84.

It is arranged that the developing roller 84 and other rollers are driven to rotate in the foregoing manner with respect to only one developing device which is located at the developing position. It is further arranged that when setting the developing device at the developing position, the gear 81 and the gear 95 securely engage with each other before the developer on the developing roller 84 touches the photosensitive drum 200. Further, when moving the developing device away from the developing position, the gear 81 and the gear 95 are held securely engaged with each other until the developer on the developing roller 84 is separated from the photosensitive drum 200 completely. For this purpose, the position of engagement between the gear 81 and the gear 95 is set near the center of the revolver developing unit 230.

In this embodiment, the revolver output gear 78 is driven by a revolver drive motor 77 in the form of a step motor or the like to rotate in a direction of an arrow B in FIG. 5A so as to rotate the revolver developing unit in a direction of an arrow C via the revolver input gear 79 to switch the developing device to be located at the developing position. Further, positioning of the revolver developing unit is performed by fitting a positioning roller 66 into a recess 65 formed at given portions on the circumference of the rear wall 51 of the revolver developing unit 230. However, if a rotation angle of the revolver developing unit 230 does not reach a required angle (for example, it is 90° for moving the adjacent developing device located at an upstream side in the direction of rotation to the developing position) due to unevenness in operation of the revolver drive motor 77 or unevenness in load of the revolver developing unit 230, the positioning roller 66 can not be fitted into the corresponding recess 65 so that the precise positioning of the revolver developing unit can not be achieved. This causes an interval between the developing roller 84 and the photosensitive drum 200 to differ from a required value.

Accordingly, the rotation control of the revolver drive motor 77 is performed in consideration of the foregoing unevenness. Specifically, the rotation control of the motor 77 is performed using a control value corresponding to a rotation angle somewhat greater than a required value (for example, greater than a required value by about 3°) so as to achieve at least the required rotation angle. On the other hand, when this control value is used to control the rotation of the revolver developing unit, the revolver developing unit rotates exceeding the required rotation angle. Accordingly, the angular moment applied to the revolver developing unit 230 due to the start of operation of the developing drive motor 80 is utilized to achieve the precise positioning. Specifically, it is arranged that, due to the rotation of the developing output gear 81 which meshes with the developing input gear 95 of the developing device located at the developing position in the direction of the arrow A in FIG. 5A (in the direction at the time of the normal developing operation), the revolver developing unit is applied with the angular moment in a direction of a hollow arrow D opposite to the normal rotation direction of the revolver developing unit 230 so as to return the unit to the proper position. It is further arranged that the return of the unit is stopped when the positioning roller 66 is fitted into the corresponding recess 65 so as to lock the revolver developing unit 230 against the further rotation in the return direction. For achieving this, a position of a pin 63 working as a pivot axis of a bracket 64 mounted with the positioning roller 66 and an abutting posture of the bracket 64 relative to the revolver developing unit are determined so that the bracket 64 can be a counter against the rotation of the unit in the return direction. Further, it is preferable that, in order to reduce the load of the drive system for releasing the engagement between the positioning roller 66 and the recess 65 of the unit when the unit rotates exceeding the required rotation angle, a slope of a recess portion 65*a* for the normal rotation is set gentler or smoother than a slope of a recess portion 65*b* for the return rotation to lock the unit as shown in FIG. 5B.

In the example shown in FIG. 3, as shown, for example, with respect to the Y developing device 231Y, a portion of each of the front and rear walls 50 and 51 supporting the developing roller 84Y and the doctor blade 85Y is formed as a small end wall portion 104Y which is separable from the other portion of the front and rear walls 50 and 51. With this arrangement, upon cleaning the inside of the developing chamber or changing the parts, it is easy to have access to the inside of the developing chamber by removing the developing roller and the doctor blade per small end wall portion 104.

Further, as shown in FIG. 5C, at a given position of the rear plate 53 on the side of the machine body confronting an end of a shaft 98*a* of the developing roller gear 98 of the developing device located at the developing position, a conductive rod-like terminal 106 connected to a developing bias power source 105 for applying a developing bias is mounted via a bracket 107 so as to be movable backward in the slide direction of the carrier pedestal. Further, the terminal 106 is urged toward the font side of the machine body by means of a conductive spring 107*a*. A tip of the terminal 106 is in the form of a semisphere. On the other hand, the end of the developing roller shaft 98*a* is formed with a recess in the form of a circular arc having a radius of curvature slightly greater than that of the semisphere of the terminal 106. With this arrangement, reduction of the contact load at the time of releasing engagement between the end of the developing roller shaft 98*a* and the tip of the rod-like terminal 106 caused by the rotation of the revolver developing unit 230 and the stability of the contact during the engagement between the end of the shaft 98*a* and the terminal 106 can be achieved.

It is arranged that the rod-like terminal 106 applies the developing bias only to the developing device located at the developing position. It is further arranged that, when setting the developing device at the developing position, the rod-like terminal 106 and the end of the developing roller shaft 98*a* securely come in contact with each other before the developer on the developing roller 84 touches the photosensitive drum 200 and that, when moving the developing device away from the developing position, the rod-like terminal 106 and the end of the developing roller shaft 98*a* are securely held in contact with each other until the developer on the developing roller 84 is separated from the photosensitive drum 200 completely.

It is arranged that the developing bias power source 105 can apply a developing bias in the form of d.c. voltage superimposed with a.c. voltage to the rod-like terminal 106. Further, an output of the a.c. voltage from the developing bias, power source 105 can be ON/OFF switched based on a control signal from a control section (see FIG. 7) at a later-described given timing independent of the d.c. voltage, and an output value of the d.c. voltage can be changed at a later-described timing.

Figure 7:
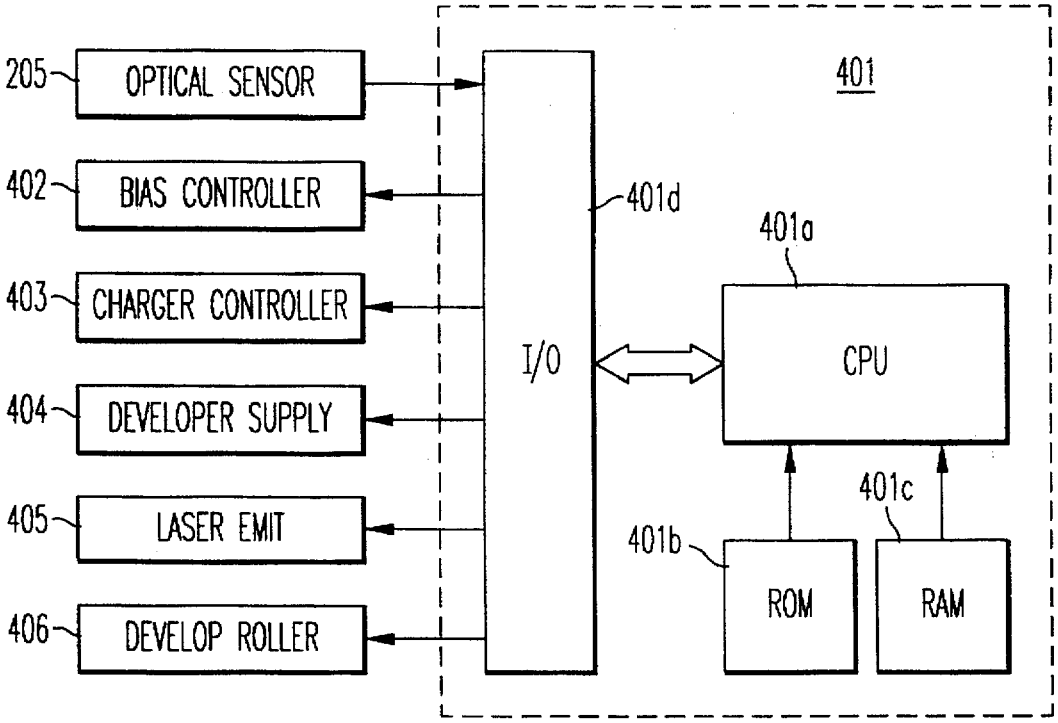
FIG. 7 is a graph schematic block diagram of a control unit for controlling the color copying machine of the present invention.
Figure 8A:
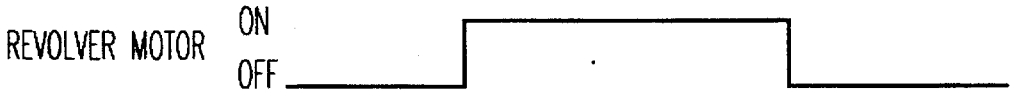
FIG. 8 is a timing chart showing timings of driving the revolver drive motor, applying a developing bias and driving the developing drive motor and of contacting the developer on the developing roller to the photosensitive drum according to an embodiment of the invention.
Figure 8B:
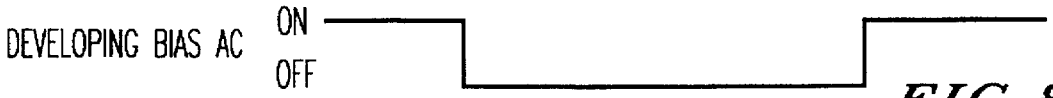
Figure 8C:
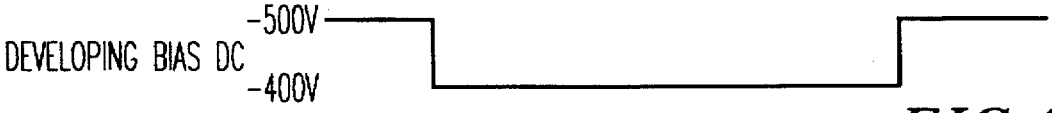
Figure 8D:
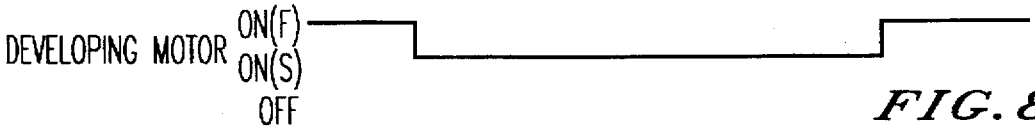
Figure 8E:
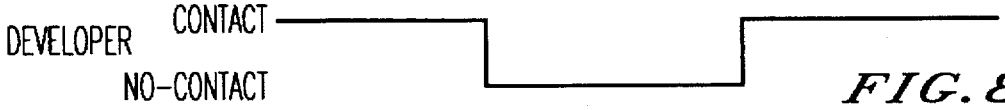

FIG. 7 is a block diagram for controlling the color copying machine. As shown in FIG. 7, a controller 401 has a CPU (central Processing Unit) 401*a*, a ROM (Red Only Memory) 401*b* a RAM (Random Access Memory) 401*c*, and I/o (input/output) interface 401*d* connected to external devices. AN output signal form the optical sensor 205 is transferred to the I/O interface, and on the other hand output signals from the I/O interface are transferred to a bias-controller driver 402 for a developer, a controller driver for a charger 403, a driver 404 for supplying a developer, a driver 405 for emitting a laser, a driver 406 for developing roller. The ROM 401*b* stores basic operating programs and data. The CPU 401*a* reads the programs and data from the ROM 401*b* and stores them in the RAM 401*c*. And this controller 401 also controls the color scanner 1, the color printer 2, the paper bank 3*a* and so on.

FIG. 8 is a timing chart showing timings of driving the revolver drive motor 77 for the revolver developing unit, of applying the developing bias, of driving the developing drive motor 80, and of contacting the developer on the developing roller 84 to the photosensitive drum 200. In this embodiment, a charged potential Vd on the surface of the photosensitive drum 200 is set to −650V. At first, a speed of the developing drive motor 80 is changed from an OF(F:fast) status to an ON(S:slow) status, so that the developing roller rotates slowly. And a voltage value of the D.C. Component of the developing bias is changed from −500V to −450V. Then, after the application of the A.C. component of the developing bias is stopped, the revolver drive motor 77 is driven to rotate the revolver developing unit so as to separate the developer from the surface of the photosensitive drum 200. Then, after the developer on the developing roller 84 of the next-color developing device comes in contact with the surface of the photosensitive drum 200 and the revolver drive motor 77 is stopped, the application of the A.C. Component of the developing bias is started, and the voltage value of the D.C. Component of the developing bias is changed from −450V to −500V. Then, the speed of the developing drive motor 80 is changed from an OF(S) status to an ON(F) status, so that the developing roller rotates at a normal speed.

Figure 2A:
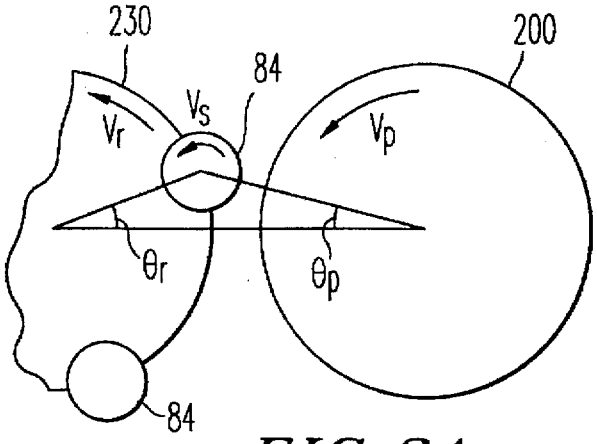
FIG. 2(*a*) is a schematic illustration showing movement of rotation of the photosensitive drum 200, the revolver developing unit 230, and the developing roller of FIG. 1, when the developer on the developing roller separates from the photosensitive drum.
Figure 2B:
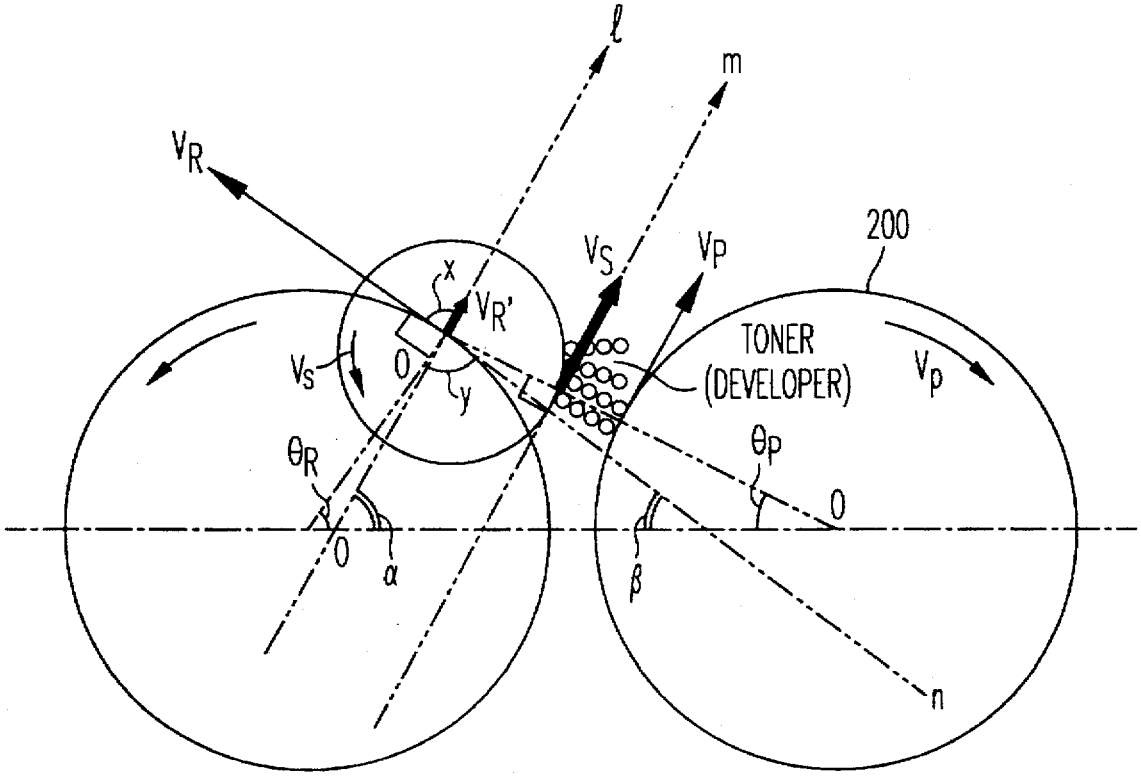

FIG. 2(*a*) is a schematic illustration showing movement of rotation of the photosensitive drum 200, the revolver developing unit 230, and the developing roller of FIG. 1, when the developer on the developing roller separates from the photosensitive drum.

In the embodiment, the developing roller and the revolver developing device rotate at opposite direction of the photosensitive drum.

In FIG. 2(*a*),

Vs=a speed of the developing roller,

Vr=a speed of the revolver developing device,

Vp=a speed of the photosensitive drum at a direction of a tangent line at the surface of the photosensitive drum, θr=a revolving angle of the revolver developing device, and θp=a revolving angle of the photosensitive drum.

Figure 9:
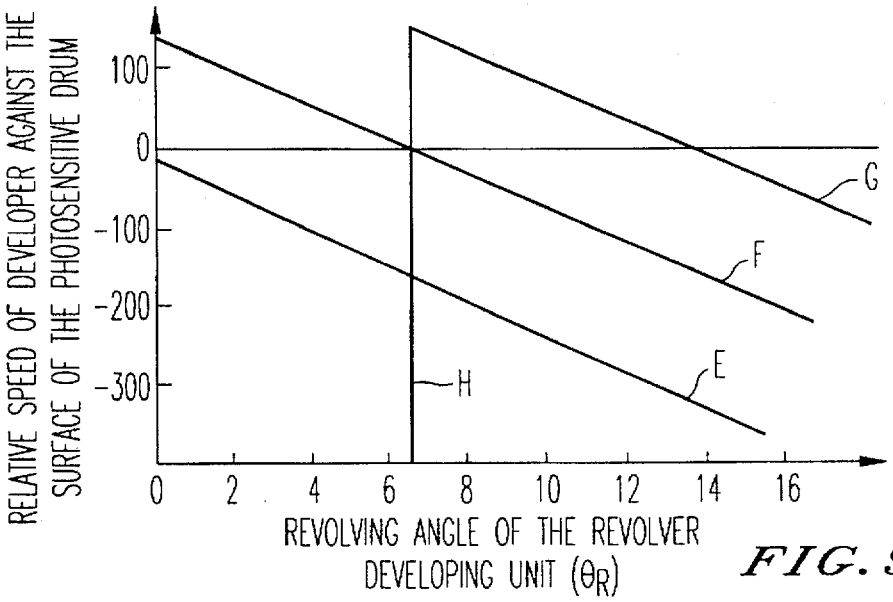
FIG. 9 is a graph showing a relationship between the revolving $\theta r$ of the revolver developing unit in the speed of the developer on the developing roller relative to the surface of the photosensitive drum.

FIG. 9 is a graph showing a relationship between the revolving angle θr of the revolver developing unit and the speed of developer on the developing roller relatively against the surface of the photosensitive drum. Each line (E, F, &G) shows a characteristic diagram obtained at a respective different speed Vr. The speed Vr for the line (E) is higher than the speed Vr for the line (F), and the speed for the line (F) is higher than the speed for the line (G). In this embodiment, when the developer on the developing roller 84 comes in contact with or separates from the photosensitive drum 200, the revolving angle of the revolver developing device (θr) is 6.5° representative H.

Figure 10:
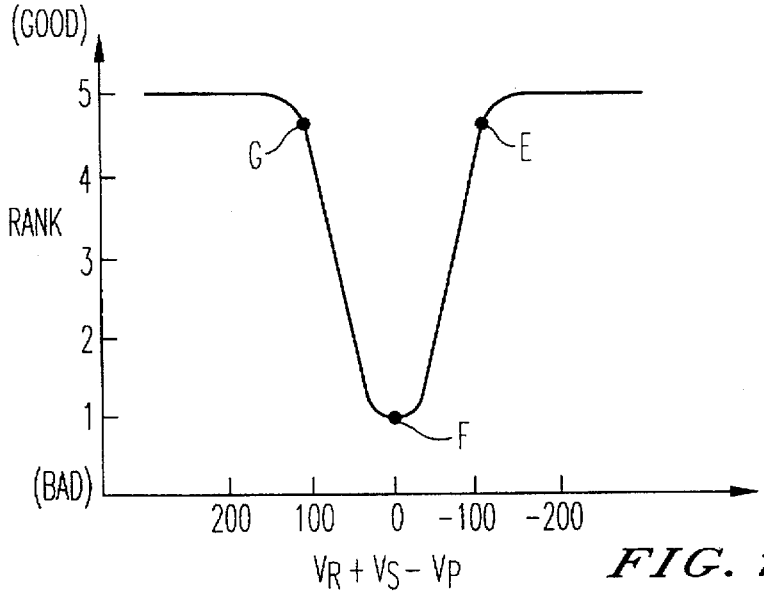
FIG. 10 is a graph showing a relationship between the speed of the developer on the developing roller relative to the surface of the photosensitive drum (representative of $Vr+Vs-Vp$)

FIG. 10 is a graph showing a relationship between the speed of developer on the developing roller relative to the surface of the photosensitive drum, represented by (Vr+Vs−

Vp), and ranks showing the amount of adhesion of the developer to the surface of the photosensitive drum. As the diagram shows, when the speed is "0" or near "0", the rank is very bad indicating considerable adhesion of the developer to the surface of the photosensitive drum. It is supposed that the reasons are that the toner among the developer is transferred to the photosensitive drum by the Vander-Waals force, and that the positively charged carrier is transferred too by the electrical force. And as the relative speed is 0, so the developer is easily transferred to the drum. Therefore, it is necessary to set the speed (Vr+Vs−Vp) to a non-zero value, because the developer can not be transferred to the drum. Even if the developer transferred to the drum, the developer is scavenged by the surface of the developing roller under the condition that the speed (Vr+Vs−Vp) is set at a non-zero value.

As shown at FIG. 10, when the developer on the developing roller moves relatively against the surface of the photosensitive drum, the rank is good. Especially, when the speed is lower than −100, or bigger than 100, the rank is perfect. In this embodiment, as the speed Vp is 105 mm/sec, those are defined as (Vs+Vr)/VP is lower than −1, or bigger than 1. The condition Vs+Vr>Vp is much more desirable, because the speed Vr of the revolver developing device can be bigger than the condition of Vs+Vr<Vp, so that it takes a short time to revolve the revolving device to change this color of the developer.

FIG. 2(*b*) is also a schematic illustration showing movement of rotation of the photosensitive drum 200, the revolver developing unit 230, and the developing roller of FIG. 1, when the developer on the developing roller separates from the photosensitive drum.

As 1//m, then $$\alpha+\theta p+90°=180°.$$

And $$\beta+\theta r+90°=180°,$$

because a line (n) is a tangent line at the surface of the revolver developing device.

$$\begin{aligned} x &= y \\ &= 180° - \alpha - \beta \\ &= 180° - (180° - 90° - \theta p) - (180° - 90° - \theta r) \\ &= \theta p + \theta r \end{aligned}$$

$$\begin{aligned} Vr' &= Vr \times \cos x \\ &= Vr \times \cos(\theta p + \theta r) \end{aligned}$$

Therefore, when the developer on the developing roller separates from the photosensitive drum, an absolute speed of the developer (D) on the developing roller in the direction of the tangent line to the surface of the developing roller is $$Vs+Vr'=Vs+Vr\times\cos(\theta p+\theta r).$$

Then as explained before, the speeds are determined as Vs+Vr×cos (θp+θr)>Vp.

In the specification the thickness of the developer on the developing roller is relatively very small, so that it can be neglected in the above formula.

Figure 11:
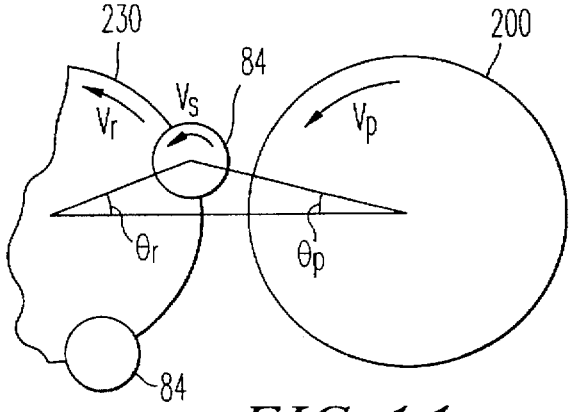
FIG. 11 is a schematic illustration showing movement of rotation of the photosensitive drum, the revolver developing unit and the developing roller when the developer of the developing roller separates from the photosensitive drum.

FIG. 11 is an another illustration showing movement of rotation of the photosensitive drum 200, the revolver developing unit 230, and the developing roller, when the developer on the developing roller separates from the photosensitive drum.

In this embodiment, the developing roller rotates in a direction opposite to that of the photosensitive drum and the revolver developing device rotates in the same direction as the photosensitive drum. In FIG. 11, Vs=a speed of the developing roller, Vr=a speed of the revolver developing device, Vp=a speed of the photosensitive drum at a direction of a tangent line at the surface of the photosensitive drum, θr=a revolving angle of the revolver developing device, and θp=a revolving angle of the photosensitive drum.

As explained before, each speed is determined as follows:

Vs−Vr<Vp.

Vs−Vr cos(θr+θp)<Vp.

(Vs−Vr)/Vp is lower than −1, or bigger than 1.

In the foregoing examples, the application of the a.c. component of the developing bias is switched, in the on/off manner. Instead of this, by switching between peak-to-peak values of the peak-to-peak voltage $V_{P-P}$ of the a.c. component, the adhesion of the developer onto the photosensitive drum 200 can be prevented similarly. For example, at the time of contact and separation between the developer on the developing roller 84 and the photosensitive drum 200 caused by the rotation of the revolver developing unit 230, by lowering a value of the peak-to-peak voltage $V_{P-P}$ of the a.c. component from 2 kV to 1 kV, 0.5 kV or the like, while superimposed on the d.c. component of the developing bias, the activation of the developer due to the a.c. component to render the developer liable to move, which would be otherwise caused as in the foregoing prior art, can be effectively suppressed so that adhesion of the developer to the photosensitive drum 200 can be avoided.

In the foregoing examples, the inversion developing method has been employed, wherein the two-component developer including the toner charged in negative is used. However, the present invention is also applicable to a developing method wherein toner charged in positive is used, a developing method where one-component developer is used, the normal developing method or the like.

The present invention uses one or more control boards within the control section of the image forming device to perform the described functions. These boards may be implemented using a conventional microprocessor or conventional general purpose digital computer programmed according to the teachings of the present application, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art. Further either mechanical or semiconductor switches connected to the control boards and power supplies may be used to switch the biasing voltages, or the power supplies may be constructed to contain the switches in order to obtain the desired biasing voltages. This type of circuit design is within the knowledge of one of ordinary skill in the art.

While the present invention has been described in terms of the preferred embodiment with several examples, the invention is not to be limited thereto, but can be embodied in various ways without departing from the principle of the invention as defined in the appended claims.

What is claimed as new and desired to be secured by letters patent of the united states is:

1. An image forming device, comprising:

a photosensitive drum having a first motor disposed to rotate the photosensitive drum;

an optical unit disposed to create a charged pattern corresponding to an original image on the photosensitive drum;

a revolver developing device to apply developer to the photosensitive drum to create a visible image on the photosensitive drum, the revolver developing device including a plurality of developing devices and a second motor disposed to rotate the revolver developing device and the plurality of developing devices, each developing device having a developing roller for carrying developer and a third motor disposed to rotate the developing roller of each developing device, wherein a rotation speed of each developing roller is determined so that the developer on the developing roller moves relative to the photosensitive member in a direction of a tangent line of developing roller against the surface of the photosensitive drum when the developer on the developing roller comes in contact with the photosensitive drum, and $Vr+Vs-Vp\neq 0$ where (Vr) is a speed of the revolver developer device, (Vs) is a speed of the developer roller, and (Vp) is a speed of the photosensitive drum; and a transfer system disposed to transfer the visible image to a sheet.

2. The image forming device as claimed in claim 1, wherein as the developing roller and the revolver developing device rotate in a direction opposite a rotation direction of the photosensitive drum, a speed of the developing roller Vs, a speed of the revolver developing device Vr, and a speed of the photosensitive drum Vp are determined so that $Vs+Vr>Vp$.

3. The image forming device as claimed in claim 1, wherein as the developing roller and the revolver developing device rotate in a direction opposite to a rotation direction of the photosensitive drum, a speed of the developing roller Vs, a speed of the revolver developing device Vr, and a speed of the photosensitive drum Vp are determined so that $Vs+Vr\cos(\theta r+\theta p)>Vp$, where $\theta r$=a revolving angle of the revolver developing device, and $\theta p$=a revolving angle of the photosensitive drum.

4. The image forming device as claimed in claim 1, wherein as the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $Vs-Vr<Vp$.

5. The image forming device as claimed in claim 1, wherein as the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $Vs-Vr\cos(\theta r+\theta p)<Vp$, where $\theta r$=a revolving angle of the revolver developing device, and $\theta p$=a revolving angle of the photosensitive drum.

6. The image forming device as claimed in claim 1, further comprising:

a controller disposed to decrease the speed of the developing roller when the developer on the developing roller is in contact with the photosensitive drum and is separating from the developing roller.

7. The image forming devise as claimed in claim 1, wherein as the developing roller and the revolver developing device rotate in a direction opposite to a rotation direction of the photosensitive drum, a speed of the developing roller Vs, a speed of the revolver developing device Vr, and a speed of the photosensitive drum Vp are determined so that $|(Vs+Vr)+Vp|>1$.

8. The image forming device as claimed in claim 1, wherein as the developing roller rotates in a direction opposite to a rotation direction of the photosensitive drum and the revolver developing device rotates in the same direction as the photosensitive drum, a speed of the developing roller Vs, a speed of the revolver developing device Vr, and a speed of the photosensitive drum Vp are determined so that $|(Vs-Vr)+Vp|>1$.

9. The image forming device, according to claim 1, wherein (Vr+Vs−Vp) has an absolute value greater than a predetermined value.

10. The image forming device according to claim 9, wherein said predetermined value is 100.

11. The image forming device according to claim 1, wherein (Vr+Vs−Vp) is greater than zero by a predetermined value.

12. The image forming device according to claim 11, wherein said predetermined value is 100.

* * * * *